US006637554B2

(12) United States Patent
Klose

(10) Patent No.: US 6,637,554 B2
(45) Date of Patent: Oct. 28, 2003

(54) RAIL BRAKE ELEMENT

(75) Inventor: Helmut Klose, Westerkappeln (DE)

(73) Assignee: A. Rawie GmbH & Co., Osnabruck (DE)

( * ) Notice: Subject to any disclaimer, the term of this patent is extended or adjusted under 35 U.S.C. 154(b) by 0 days.

(21) Appl. No.: 10/161,045

(22) Filed: May 31, 2002

(65) Prior Publication Data

US 2002/0185345 A1 Dec. 12, 2002

(30) Foreign Application Priority Data

Jun. 1, 2001 (DE) ..... 201 09 139 U

(51) Int. Cl.[7] ..... B61H 13/00

(52) U.S. Cl. ..... 188/250 R; 104/259; 188/62; 188/38

(58) Field of Search ..... 188/250 R, 62, 188/240, 63, 380, 250 G, 165, 35; 104/259, 254, 258

(56) References Cited

U.S. PATENT DOCUMENTS 5,836,252 A * 11/1998 Roick ..... 104/259
6,237,726 B1 * 5/2001 Roick ..... 188/38

FOREIGN PATENT DOCUMENTS

DE 24 53 223 5/1976
DE 34 22 230 12/1985
DE 3443480 A1 * 5/1986
WO WO 96/26856 * 1/1996

* cited by examiner

*Primary Examiner*—Christopher P. Schwartz
*Assistant Examiner*—Melanie Torres
(74) *Attorney, Agent, or Firm*—Vidas, Arrett & Steinkraus, P.A.

(57) ABSTRACT

A rail brake element, in particular in connection with rail brake buffer blocks, comprising a pair of clamping plates C-shaped in cross section and having upper and lower leg portions, the clamping plates engaging a rail head on opposite sides, at least one braking block element having a flat lower surface which engages the top surface of the rail head and two upper roof-like tapered surfaces, whereby the block element and the brake linings are pressed against the rail head, characterized in that the tapered surfaces of the block element have an angle relative to a horizontal plane of at least 20° and the block element and the clamping plates are dimensioned such that the end of the upper leg portions of the clamping plates have a significant distance from the upper edge of the associated tapered surface if the rail head is not worn.

3 Claims, 1 Drawing Sheet

RAIL BRAKE ELEMENT

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The invention refers to a rail brake element, in particular in connection with rail brake buffer blocks. Rail brake elements of the kind mentioned above are known from DE 24 53 223 or DE 34 22 230. The known elements include two clamping plates C-shaped in cross section and adapted to engage a rail head from opposite sides. Lower leg portions of the clamping plate engage the lower surfaces of the rail head and are provided with a braking lining. The upper leg portions of the clamping plates lie on tapered or oblique surfaces of a braking block element. The lower surface of the block element is supported by the upper surface of the rail head. At least one clamping bolt interconnects the clamping plates and presses the clamping plates towards the rail head and against the braking block so that a braking effect occurs if the braking element is displaced by a vehicle on the rail. Such a displacement preferably takes place by a buffer block which is supported on the rails and may be easily displaced or wherein braking elements are integrated. It is also known to provide further braking elements in front or in the rear of the buffer block in order to increase the braking capacity. Normally, the braking elements are spaced from each other so that upon a buffing the static friction of the individual braking elements is overcome one after the other. As known, the static friction is at least the double of the sliding friction.

Usually, the rails undergo a wear. This can result in a wear amount of the half of the height of the rail head until it is replaced. When manufacturing the braking blocks for the braking elements, the height of the rail head is measured with a tolerance of maximum 2 mm. Since the wear normally is in a wider range, it is necessary to provide different braking blocks for different heights of the rail heads. Only by a correct seat of the braking element the necessary and calculated braking capacity is guaranteed. Further tolerances may occur through unprecise measuring methods, by the manufacturing, and the assembling of the individual parts.

SUMMARY OF THE INVENTION

The invention provides a braking element wherein independent of the height of the rail head a uniform braking block can be used.

In the braking element according to the invention the upper tapered surfaces have an inclination of at least 20°, preferably of approximately 25° relative to a horizontal plane. The braking block and the clamping plates are dimensioned such that the upper end of the upper leg portions of the clamping plate are significantly spaced from the upper edge of the associated tapered surface.

The C-shaped clamping plates are conventionally standardized, i.e. they have uniform sizes. In case of a wear of the rail head the upper leg portion automatically moves along the upper tapered surface which was not possible with conventional braking blocks. Conventional braking blocks have a relative small angle of inclination of approximately 10 to 15°. This inclination was regarded as necessary in order to achieve a sufficient wedging effect by the associated leg portions of the clamping plate. Known clamping blocks are provided with an abutment edge defined by a step-shaped elevation of the braking block and which serves to indicate the wear. Already with a small wear the ends of the upper leg portions of the clamping plates reach the abutment edge.

In the braking element according to the invention the braking block is provided with a significant larger inclination which may be up to 25°. It has been found out that also with such an inclination a sufficient wedging effect is achieved to arrive at the necessary clamping and braking force. The larger angle of inclination and the corresponding distance between the ends of the upper clamping legs and the upper edges of the tapered surfaces allow a significant wear of the rail head. Differences in the height of 5 mm and more can be met without the need of a different braking block having modified dimensions.

The braking block according to the invention, thus, can be used for a large range of wear of different rails and nevertheless guarantees a sufficient seat and a satisfactory braking effect. The universal application of the braking block reduces the expenses for the manufacture and the inventory if compared with the prior art. A further advantage is to be seen in that despite of tolerances by the manufacture of the parts and the assembling thereof the necessary security of the braking element is achieved.

BRIEF DESCRIPTION OF THE DRAWINGS

The invention is subsequently described along an embodiment example shown in the accompanying drawings, wherein.

DETAILED DESCRIPTION OF THE DRAWINGS

Figure 1:
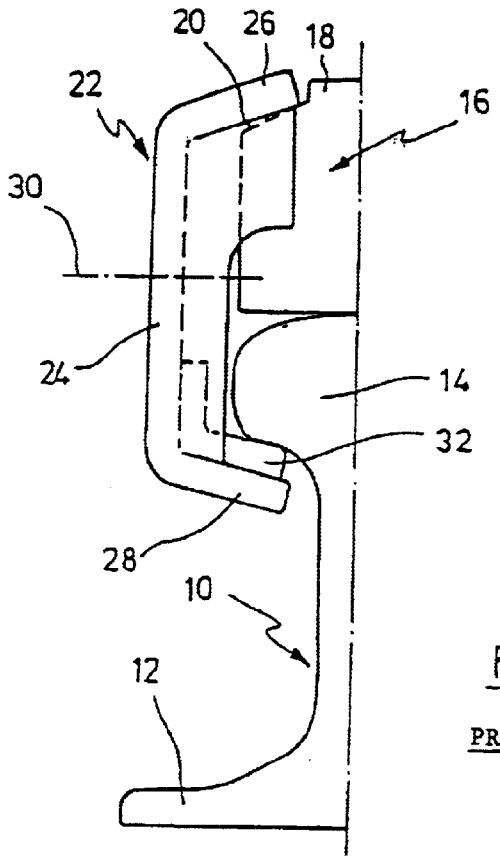
FIG. 1 PRIOR ART
FIG. 1 shows partial in cross section a braking element of the prior art.

In FIG. 1 a conventional rail 10 is illustrated having a foot 12 and a rail head 14. A braking block element 16 is sitting on the rail head and is approximately rectangular in cross section except the upper portion. In the longitudinal center thereof a step-shaped elevation 18 is provided and oblique or tapered surfaces 20 could be seen on both sides of the elevation. Such a braking block is made of a suitable friction material, e.g. bronze or grey cast iron. Such a braking block has become known by DE 24 53 223. The angle of inclination for the tapered surfaces is approximately 10°.

On both sides of the braking head 14 clamping plates are positioned, one of which being shown at 22. The clamping plate 22 is C-shaped in cross section and has a plate-shaped web portion 24 and an upper leg portion 26 and a lower leg portion 28. The leg portions 26, 28 are slightly outwardly bent. At the ends the mentioned parts are bent inwardly whereby stop means are provided for the braking block 16 effecting in the direction of the rail.

By means of at least one clamping bolt not shown in FIG. 1, the effect thereof being indicated by the dash-dotted line 30, the oppositely located clamping plates 22 can be pressed towards each other. The clamping bolts extend through corresponding holes in the clamping plates 22 and through a bore in the braking block 16 or a corresponding recess thereof. The upper leg portion 26 of the clamping plate 22 engages the tapered surface 20 while the lower leg portion

28 has a braking lining 32 and grips under the rail head 14. Upon a pressing of the clamping plates 22 towards each other the described parts are set under pressure so that the braking lining 32 and the braking block 16 as well are brought in a braking engagement with the rail head 14.

Figure 2:
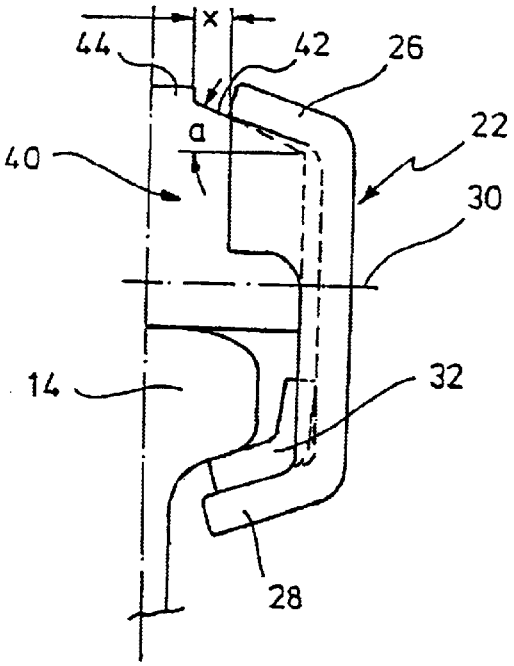
FIG. 2 shows a similar cross section as FIG. 1 with the features of the invention.

The embodiment shown in FIG. 2 differs from that of FIG. 1 by the shaping of the braking block 40. The rail head 14 and the clamping plate 22 are similar to corresponding parts of FIG. 1. Therefore, they are provided with the same reference number. The braking block 40 has oblique surfaces 42 which in the case shown have an angle a of 25° relative to the horizontal plane. This corresponds to a slope of 1:2,145. An upper elevation 44 similar to elevation 18 of FIG. 1 is arranged such that the upper end of the upper leg portion 26 has a significant spacing relative to the upper edge of the tapered surface at least with a rail head 14 not worn. The distance is indicated in FIG. 2 by an x. By the dimension x the upper leg portion of the clamping plate may approach the edge of the elevation 44 if the rail head 14 due to wear loses height. The indicated distance x corresponds approximately to a wear of 5 mm. Thus, the braking block 14 can be also used with rail heads 14 having a smaller height without necessitating a modified dimensioning. The compensation for height is a result of the relative large inclination of the tapered surfaces 42. On the other hand, this inclination is sufficient to generate a satisfactory wedging effect and thus a satisfactory braking effect.

It is understood that between the braking block 40 and the web portion of the clamping plates 22 sufficient clearance exists so that the upper leg portion 26 may move up to the elevation 44.

What is claimed is:

1. A rail brake element, in connection with rail brake buffer blocks, comprising a pair of clamping plates C-shaped in cross section and having upper and lower leg portions, the clamping plates engaging a rail head on opposite sides, at least one braking block element having a flat lower surface which engages the top surface of the rail head and two upper roof-like tapered surfaces, the upper leg portions of the clamping plates engaging the associated tapered surfaces, the lower leg portions having at the side facing the rail head a brake lining in engagement with the lower surfaces of the rail head, and at least one clamping bolt by which the clamping plates can be pressed towards each other, whereby the block element and the brake linings are pressed against the rail head, characterized in that the tapered surfaces of the block element have an angle relative to a horizontal plane of at least 20° and the block element and the clamping plates are dimensioned such that the end of the upper leg portions of the clamping plates have a significant distance from the upper edge of the associated tapered surface if the rail head is not worn.

2. The brake element of claim 1, wherein the angle relatively to a horizontal plane is approximately 25°.

3. The brake element of claim 1, wherein the braking block at the upper side has a step-shaped elevation in the longitudinal center thereof, the elevation together with the associated tapered surface forming a stop edge, and the ends of the upper leg portions of the clamping plates have a significant spacing from the stop edge.

* * * * *